United States Patent [19]

Clark et al.

[11] Patent Number: 4,866,222

[45] Date of Patent: Sep. 12, 1989

[54] ROTATIVELY POWER OPERATED ELECTRICAL SWITCHING DEVICE

[75] Inventors: Thomas A. Clark, Santa Monica; James E. Brockway, Venice, both of Calif.

[73] Assignee: G&H Technology, Inc., Santa Monica, Calif.

[21] Appl. No.: 182,514

[22] Filed: Apr. 18, 1988

[51] Int. Cl.[4] ..... H01H 3/40; H01H 15/08

[52] U.S. Cl. ..... 200/16 E; 200/500

[58] Field of Search ..... 200/16 R, 16 B, 16 E, 200/158, 163, 51 R, 51.03–51.08, 51.12, 17 R, 18, 500, 564, 572; 439/310

[56] References Cited

U.S. PATENT DOCUMENTS

| | | | |
|---|---|---|---|
| 677,455 | 7/1901 | Von Kando | 200/16 E |
| 2,482,464 | 9/1949 | Chapman | 200/158 X |
| 4,020,300 | 4/1977 | Nassif | 200/158 X |
| 4,074,094 | 2/1978 | Lubbe | 200/163 X |
| 4,563,549 | 1/1986 | Lycan | 200/16 E X |
| 4,639,558 | 1/1987 | Lycan | 200/16 E X |

*Primary Examiner*—J. R. Scott

*Attorney, Agent, or Firm*—George J. Netter

[57] ABSTRACT

A switching device having an open-ended hollow cylindrical housing with a number of slots in the sidewall. An insulative piston is slidably movable along the housing longitudinal axis and has a threaded central opening receiving a similarly threaded axle. A receptacle switch part fits onto a housing end and includes a central opening through which an unthreaded portion of the axle extends. Openings in the receptacle switch part each have a sleeve contact with outwardly extending tabs for electrical connection to cable wires, or the like. The piston has a plurality of pin contacts fixedly mounted thereto with portions extending from both sides of the piston for electrical connection to cable wires, for example, and which respectively align with a sleeve contact in the switch part. A further receptacle switch part is affixed to the housing other end. Rotative power drives the piston along the housing to effect connection between the contacts.

7 Claims, 1 Drawing Sheet

FIG. 1
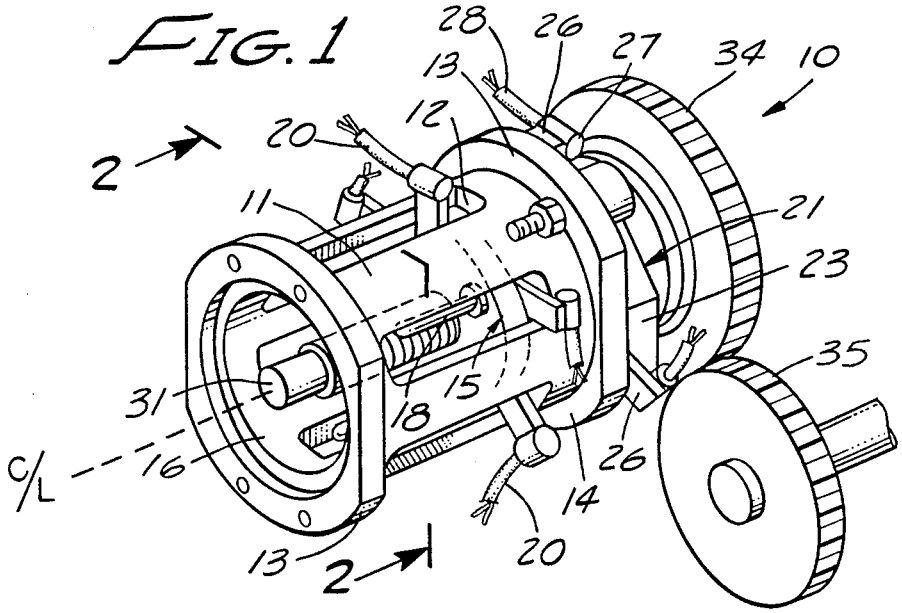
FIG. 2
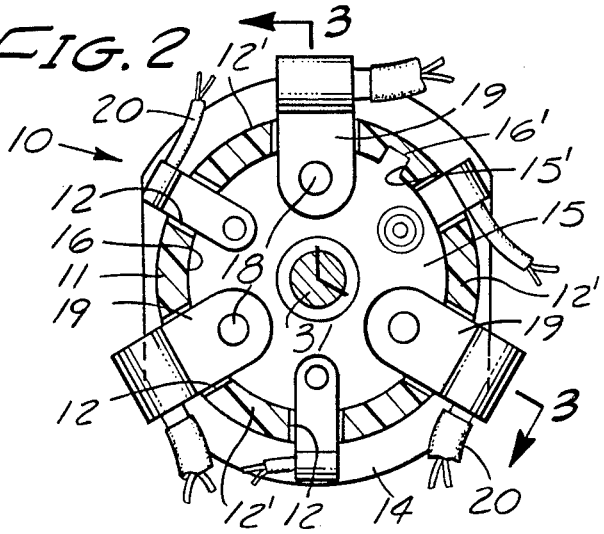
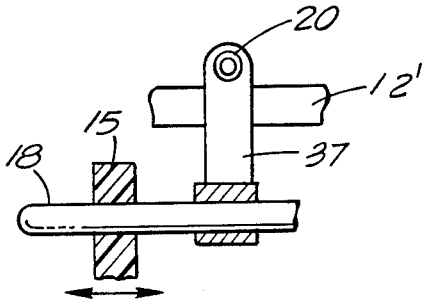
FIG. 4
FIG. 3
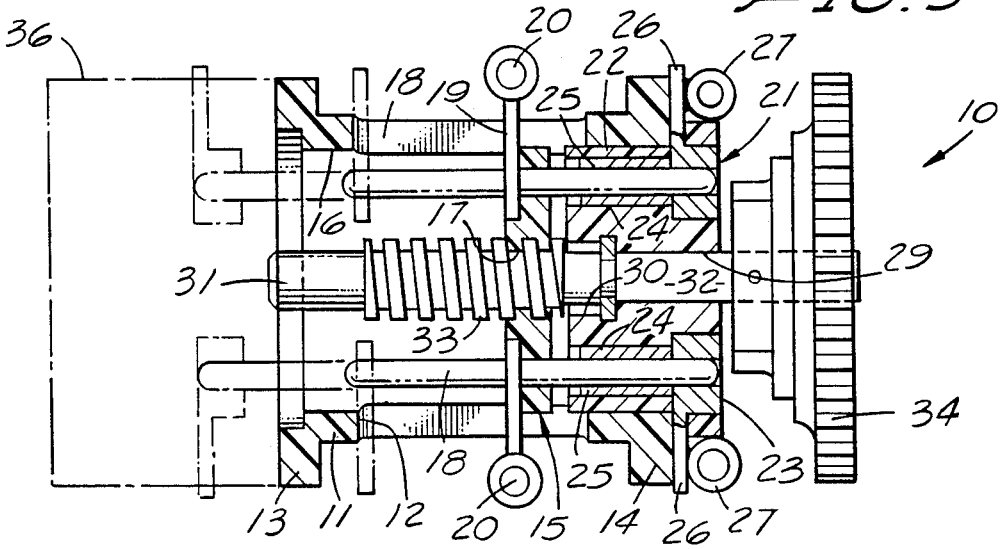

ROTATIVELY POWER OPERATED ELECTRICAL SWITCHING DEVICE

The present invention pertains generally to an electrical switching device, and, more particularly, to such a switching device which is actuated to its connection modes by a rotative mechanical power source.

BACKGROUND OF THE INVENTION

There are many situations in which it is desirable to be able to actuate a switching means by electrical power means and, more particularly, through the use of a rotative mechanical power device such as an electric motor. Also, there are circumstances where several connective aspects may be desired for the same sets of cables, and it may be advantageous to accomplish this by driving the switching device with a single rotative power source such as a reversible motor.

SUMMARY OF THE DISCLOSURE

The described switching device includes an insulative hollow cylindrical housing with open ends and a plurality of elongated slots in the sidewall. An insulative piston is dimensioned for fitting location within the bore of the housing and movable along the housing longitudinal axis from substantially one end to the other. Limit stops at each end of the housing prevent the piston from moving outwardly of the housing. The piston has a threaded central opening within which a similarly threaded axle is received.

A first receptacle switch part is fitted onto one end of the housing and includes a central opening through which an unthreaded portion of the axle extends outwardly of the switch part. A plurality of openings are provided in the receptacle switch part, each having a conductive sleeve contact therein with outwardly extending tabs for electrical connection to cable wires, or the like. The piston has a plurality of pin contacts fixedly mounted thereto with portions extending from both sides of the piston and which respectively align with an opening of a sleeve contact in the first receptacle switch part. The pin contacts each have a connecting tab or electrode which passes through a respective housing slot for connection via a lead wire, for example, to exterior equipment.

A second receptacle switch part, which may be identical to the first receptacle switch part, is mounted on the opposite housing end and includes a set of openings therein in alignment with the pin contacts carried by the piston. Relative dimensions of the pins and the overall length of the housing are such that each pin will come into contact with the respective sleeve contact of, say, the first receptacle switch part before the opposite end of the same pin is removed from the corresponding sleeve contact of the second receptacle contact.

A drive gear is affixed to the outer end of the axle and, in turn, meshes with a similar gear on a source of mechanical rotative power. In operation, when the drive gear is rotated in a first direction the piston is driven towards the first receptacle until the pin contacts are received within the corresponding sleeve contacts and in that way a first electrical connection arrangement is obtained. On driving the axle, and thus the piston, in the opposite direction, the first described connection arrangement is broken, and then a second one is formed when the pin contacts are received within the sleeve contacts of the second receptacle switch part.

BRIEF DESCRIPTION OF THE DRAWING

FIG. 1 is a perspective view of the rotatively powered electrical switch of this invention.

FIG. 2 is an end elevational, sectional view taken along the line 2—2 of FIG. 1.

FIG. 3 is a side elevational, sectional view taken along the line 3—3 of FIG. 2.

FIG. 4 depicts an alternate embodiment.

DESCRIPTION OF A PREFERRED EMBODIMENT

Turning now to the drawings, the electrical switch of the present invention is identified generally by the numeral 10 and is seen to include an elongated, hollow, generally cylindrical housing 11 constructed of a good insulating material (e.g., molded plastic), and having a plurality of longitudinal slots 12 which pass completely through the housing having sidewalls 12'. At the two ends there are enlarged circumferentially extending flanges 13 and 14, respectively, which are unitary with the housing sidewalls.

An insulative disc-like piston 15 is so dimensioned as to enable sliding receipt within the circular bore 16 of the housing and permitting the piston to move easily from one end to another, in either direction. During piston movement, a key 16' on the outer surface of the piston moves along a longitudinally extending, straight-line slot or keyway groove 15' which prevents piston rotation. The piston also includes at its circular center point a threaded opening 17 for a purpose to be described. A plurality of elongated metal pin contacts 18 are fixedly mounted to the piston and have parts 18' and 18'' extending from both sides of the piston substantially parallel to the housing longitudinal axis. In a way that will be more particularly described, these pin contacts serve as interconnecting means for the switch. Also, each pin has a metal tab or electrode 19 conductively affixed to its respective pin and which extends outwardly through one of the housing slots 12 (FIG. 2) for interconnection in a way well known in the electrical art, to wires 20, or other externally located apparatus.

A first receptacle switch part 21 consists of an electrically insulative body member having a cylindrical portion 22 which can be snugly fitted within the bore of the housing 11 at one end and terminates at an, enlarged, generally cylindrical disclike insulative flange 23 that abuts against the end face of housing flange 13, 14. Threaded means (not shown) may be used to secure the receptacle switch part in assembled condition to the housing end.

A plurality of passages 24 extend through the receptacle switch part along lines generally parallel to the longitudinal axis of the housing 11 and respectively align with a pin contact 18 carried by the piston. Metal sleeves 25 are secured within each passage and have an internal bore dimensioned to receive the pin contacts in such manner as to establish good conductive relation therebetween. The outer end surface of flange 23 includes platelike electrodes 26, each conductively secured to a separate sleeve 25 without closing off the sleeve opening. The electrodes are fixedly secured to the flange 23 and include at their outer ends means 27 for being connected to cable wires 28, for example.

A central opening 29 is formed in the switch part 21 with a relatively short slightly enlarged diametral portion 30 opening into the central cavity of the housing. A drive axle 31 with a smooth surface end portion 32 is slidingly received within the receptacle opening 29 and secured therein by a "C" clip, for example, which permits axle rotation in either direction but prevents longitudinal movement. The inner end portion of the drive axle is threaded at 33 with threads which can mesh with the threads 17 within the piston 15. Accordingly, rotation of the axle drives the piston 15 longitudinally through the housing bore in a direction depending upon the direction of rotation.

At the outer end of the axle, there is affixed a drive gear 34 for meshing with a further gear 35 mounted onto a shaft of a source of mechanical rotational power (not shown).

Although only one receptacle switch part is shown and described in detail, it is preferred that a second receptacle switch part 36 identical to the first be located at the housing opposite end, as shown in dotted line configuration. Since the construction will be the same, details are not given. By having two switch parts 21 and 36, the entire switch is provided two sets of connections for the cable wires 20 depending upon the location of the piston 15.

In operation of the switching device described and assuming initial conditions as shown in FIG. 3, rotative power applied to the gear 35 turns drives the gear 34 to rotate drive axle 31 and cause the piston to move from the position shown toward the left. First, the pin contacts 18 are received in connective relation within the sleeve contacts of the second switch part 36 following which (on further driving) the opposite ends of the pin contacts are removed from the sleeve contacts 25. In this way, an electrical connection would be established between cable wires connected to the electrodes through the pin contacts and the sleeve and electrodes of the second receptacle switch part to the cable wires 20 interconnected with the piston pin contacts.

When reverse mechanical power is applied to the axle, then the piston 15 would be returned toward the right to reestablish the connective mode shown in FIG. 3.

The switching device as described to this point is a "make-before-break" configuration. Alternatively, the device can be modified to a "break-before-make" form by having the pin contacts 18 free from contacting a sleeve contact 25 for a part of the piston midstroke.

A still further alternative depicted in FIG. 4 replaces each electrode 19 with a sleeve contact 37 secured to an insulative sidewall 12'' which continuously and slidingly interconnects each pin 18 with a cable wire 20 throughout the full piston stroke movement. This embodiment avoids flexing the cable wire as happens in the first described version.

I claim:

1. A rotatively actuated electrical switching device having two interconnection modes, comprising:

walls forming a hollow cylindrical housing with opposed open ends, said walls including a plurality of generally parallel slots extending between the housing open ends;

an insulative piston received within the hollow housing and slidable between the housing opposed open ends;

means interrelating the piston and housing walls for preventing rotation of the piston;

a plurality of pin contacts mounted to the piston, each pin contact having a first end portion extending toward one housing open and a second end portion extending toward the other housing open end;

an interconnection tab conductively affixed to each pin contact and extending through a housing slot;

a first receptacle secured to the housing over a housing open end and including a plurality of metal sleeves respectively aligned to receive a pin contact first end portion therewith on the piston being moved adjacent said housing open end;

a second receptacle secured to the housing over the other housing open end and including a plurality of metal sleeves respectively aligned to receive a pin contact second end portion therewithin on the piston being moved adjacent said housing other open end;

an axle rotatively mounted in one of said receptacles with a threaded portion received within a similarly threaded opening in the piston; and means for applying rotative motion to axle to cause sliding movement of the piston.

2. A rotatively actuated electrical switching device as in claim 1, in which the pin contact first end portions are received within the first receptacle metal sleeves prior to removal of the pin contact second end portions from the second receptacle metal sleeves.

3. A rotatively actuated electrical switching device as in claim 1, in which the means interrelating the piston and housing walls includes a key and keyway groove.

4. A rotatively actuated electrical switching device as in claim 3, in which the housing has a cylindrical cavity within which the piston slides and enlarged flanges located at each open end, the keyway groove extending along the housing wall parallel to the cavity axis, and the key is located on the piston slides along the keyway groove.

5. A rotatively actuated electrical switching device as in claim 4, in which the piston is a generally circular disk slidingly received within the housing cavity and the pin contact first and second end portions extend generally parallel to the housing cavity axis and away from opposite faces of the piston disk.

6. A rotatively actuated electrical switching device as in claim 1, in which the pin contact first end portions are only received within the first receptacle metal sleeves after the pin contact second end portions are removed from the second receptacle metal sleeves.

7. A rotatively actuated electrical switching device having two interconnection modes, comprising:

walls forming a hollow cylindrical housing with opposed open ends, said walls including a plurality of generally parallel slots ectending between the housing open ends;

an insulative piston received within the hollow housing and slidable between the housing opposed open ends;

means interrelating the piston and housing walls for preventing rotation of the piston;

a plurality of pin contacts mounted to the piston, each pin contact having a first end portion extending toward one housing open end and a second end portion extending toward the other housing open end;

a plurality of sleevelike connectors each contactingly and slidably received upon a different pin contact, said connectors being fixedly mounted to the housing walls;

a first receptacle secured to the housing over a housing open end and including a plurality of metal sleeves respectively alsigned to receive a pin contact first end portion therewithin on the piston being moved adjacent said one housing open end;

a second receptacle secured to the housing over the other housing open end and including a plurality of metal sleeves respectively aligned to receive a pin contact second end portion therewithin on the piston being moved adjacent said other housing open end;

an axle rotatively mounted in one of said receptacles with a threaded portion received within a similarly threaded opening in the piston; and means for applying rotative motion to axle to cause sliding movement of the piston.

* * * * *